United States Patent [19]

Herrmann

[11] 3,968,894

[45] July 13, 1976

[54] SAFETY CLOSURE CAP

[76] Inventor: Ernst Herrmann,
Kunststoff-Spritwerk Nord 27, 9428
Walzenhausen, Switzerland

[22] Filed: Sept. 29, 1975

[21] Appl. No.: 617,727

[30] Foreign Application Priority Data

Oct. 2, 1974 Switzerland ..... 13264/74

[52] U.S. Cl. ..... 215/220; 215/258

[51] Int. Cl.[2] ..... B65D 55/02; B65D 85/56; A61J 1/00

[58] Field of Search ..... 215/9, 220, 221, 258

[56] References Cited

UNITED STATES PATENTS

| | | | |
|---|---|---|---|
| 2,964,207 | 12/1960 | Towns | 215/220 |
| 3,394,829 | 7/1968 | Peterson | 215/220 |
| 3,857,505 | 12/1974 | Mumford et al. | 215/220 |

*Primary Examiner*—George T. Hall
*Attorney, Agent, or Firm*—Young & Thompson

[57] ABSTRACT

A safety closure device for threaded neck bottles which can not be opened by young children because to open it, it is necessary to simultaneously press and turn the closure cap. The closure cap is made of two parts housed the one within the other, the outer one comprising a guarantie ring and ratching formations cooperating with ratching formations of the inner part. Driving members provided on said outer and inner parts coopering together only when these two parts are displaced relatively against a spring means.

7 Claims, 6 Drawing Figures

SAFETY CLOSURE CAP

The present invention has for its object a safety closure cap having a guarantie ring which can only be opened by the combination of two movements, combination which is not possible for young childrens. In fact, once the closure cap is set on the neck of a bottle provided with a screwed portion, the cap is thread completely by means of a rotation toward the right. A rotation toward the left alone does not cause the opening of the cap, this one is revolving idle. In order to open the cap it is necessary to push it toward the bottle and to simultaneously turn it to the left. The cap is then able to unscrew itself causing simultaneously the tearing down of the guarantie ring.

The attached drawing shows schematically and by way of example one embodiment of the safety closure cap.

Figure 5:
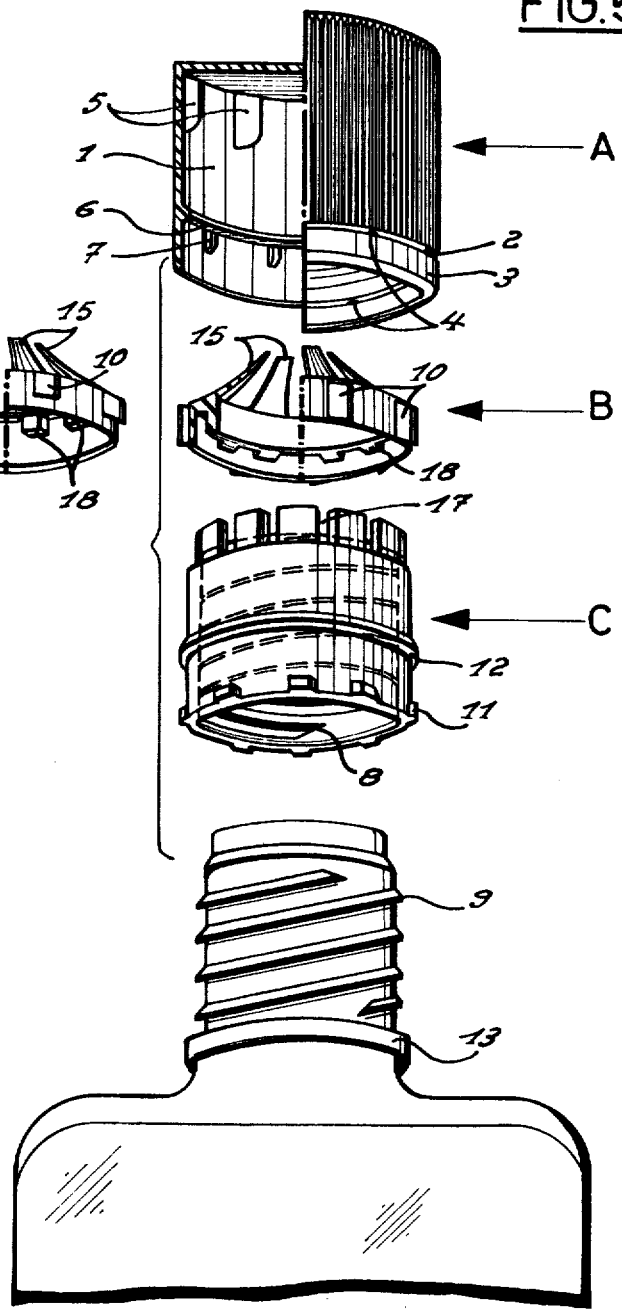
FIG. 5 is a view of the different parts of an other embodiment of the cap.
Figure 5A:
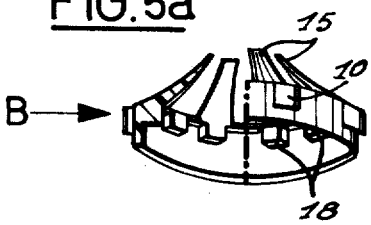

FIG. 5*a* is a partial view of a variant of the cap.

The safety closure cap shown at FIGS. 1 to 4 comprises an outside cup A the skirt 2 of which is connected to a guarantie ring 3 through detachable pads 4.

The lateral wall of said cup A shows, near its bottom, ratching formations 5 showing the form of small lugs directed toward the inside and toward the right when looking at the cup A through its opened end.

The lateral wall of the cup A comprises further a circular rib 6 forming an axial abutment located at about ⅓ or ¼ of the height of the cup A counted from its opened end. Driving members 7 extending from said rib 6 toward the opened end of the cup A merge on the inside wall of the lateral wall 1 of said cup A.

The cap comprises further an internal part C comprising a skirt, the internal surface of which is provided with a thread 8 intended to cooperate with the thread 9 of the neck of the bottle.

The outside wall of this skirt comprises at one of its end ratching formations 10, intended to cooperate with the corresponding formations 5 of the cup A. The formations 10 have the shape of flaps which are resiliently deformable, extending toward the outside and toward the left when looking the skirt from its end entering first in contact with the neck of the bottle.

The other end of the skirt has driving members 11 extending toward the outside and intended to cooperate with the driving members 7 of the cup A.

A member B resiliently deformable in the axial direction is made to fit on the end of the internal part C comprising the ratching formation 10. Finally the skirt of the internal part C has an outside rib 12 located approximately at half of the height of the skirt.

Figure 1:
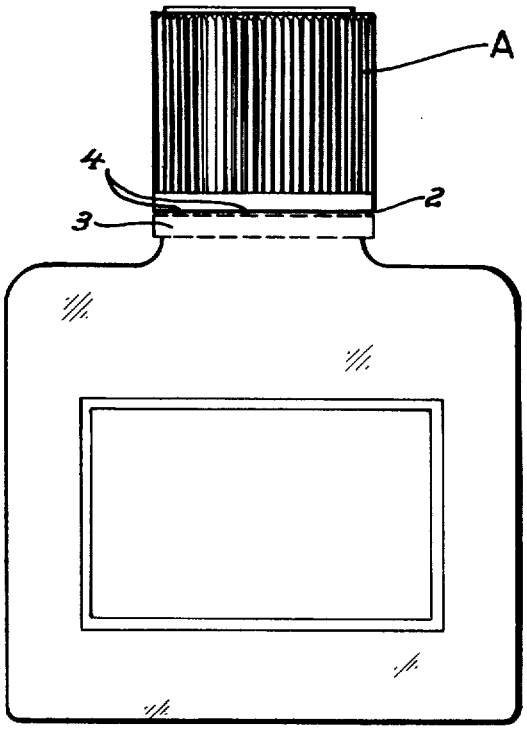
FIG. 1 is a front view of the cap threaded on a bottle.
Figure 2:
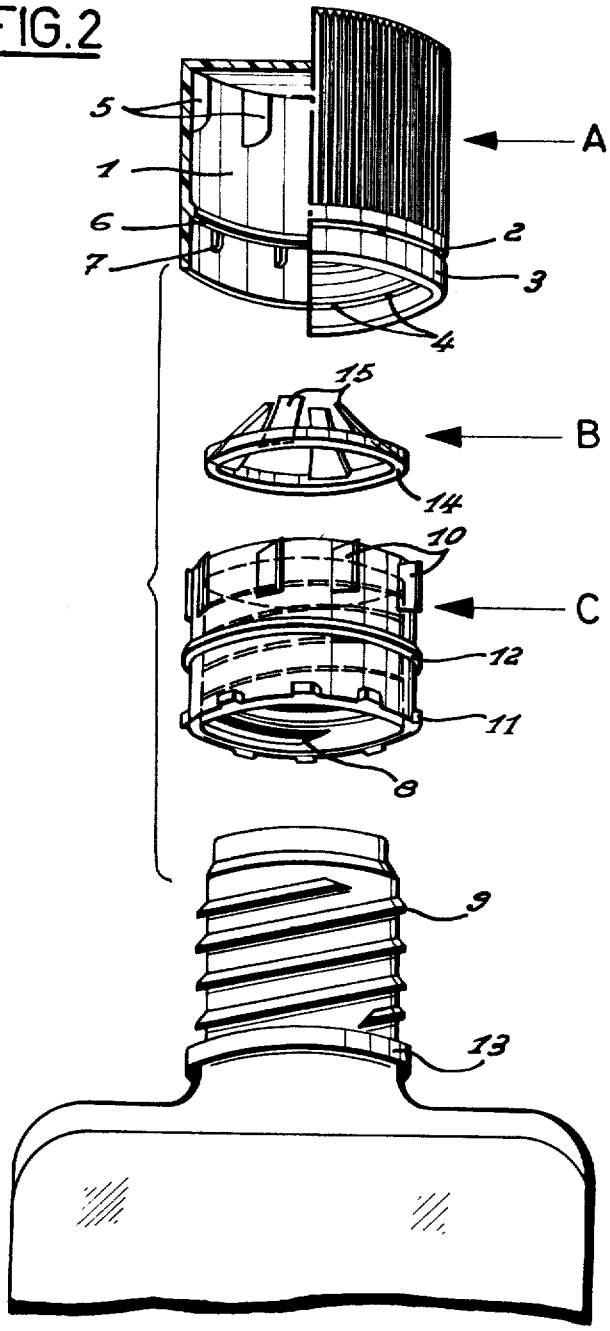
FIG. 2 shows the different constitutive parts of the cap.
Figure 4:
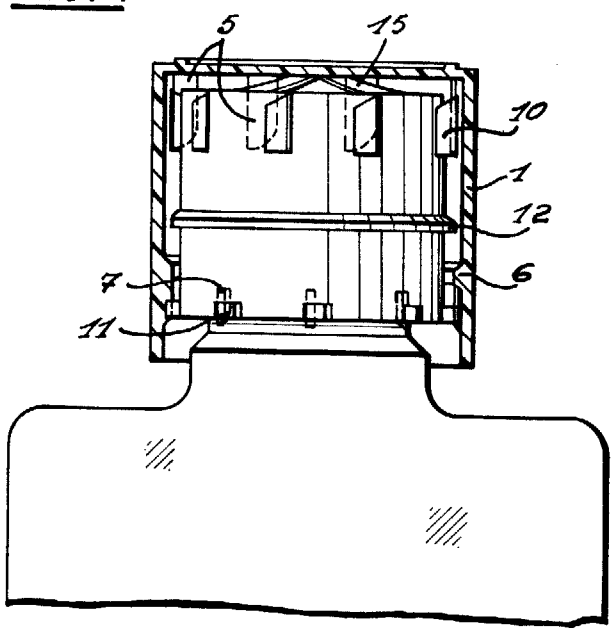
FIG. 4 is an axial cross section of the cap in the position for which it is able to be unscrewed.
Figure 3:
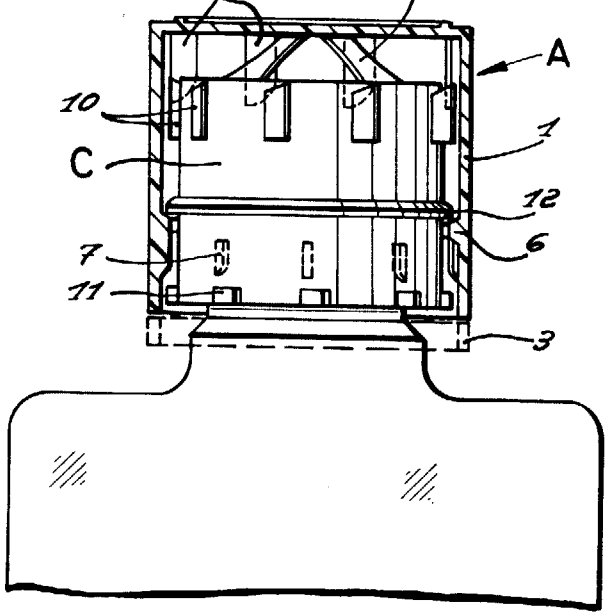
FIG. 3 is an axial cross section of the cap in threaded position.

The part 3 is constituted by a ring 14 the internal periphery of which carries resilient lugs 15 extending radially toward the top, outside of the plan constituted by the ring 14. The part 3 which is resiliently deformable, and which is independent in this embodiment, as shown in FIG. 2, may in a variant be fast with the bottom of the cup A or fast with the head of the internal part C.

The internal part C, provided with its end B constituting a spring, is engaged through said end within the cup A until the rib 12 of the skirt of the internal part C is located beyond the rib 6 of the cup A. Thus the internal part C is retained within the cup A. This internal part is however displaced toward the opening of the cup A through the spring B. In this axial position (FIG. 3), the ratching formations 7 and 10 of the skirt of the internal part C and of the cup A are cooperating. A rotation of the cup A in the direction of the hands of a watch, the cup being seen from its closed end, causes the driving of the internal part C. Through a rotation in the other side of the cup A, the internal part C is maintained still, the ratching formations 10 being resiliently deformable. It is thus possible to screw the cap on the threaded neck 9 of a bottle. By doing this, the guarantie ring 3 is brought to be located under a retaining formation 13 of the neck. A rotation in the other direction, contrary to the hands of a watch, of the cup A does not permit to unscrew the cap.

To unscrew the cap, it is necessary to push on the cup toward the bottle (FIG. 4) against the action of the spring of the internal part B. This places the driving members 11 of the internal part C on the path of the driving members 7 of the cup A and when this cup is then rotated in the direction contrary to the hands of a watch, in simultaneously maintaining the axial displacement, it drives the internal part C which is unscrewed from the neck. The axial displacement of the cup A which is thereby obtained causes the tearing off of the guarantie ring and the cap can be withdrawn.

This cap has the important advantage that one may choose the constitutive material of the three parts A, B, C in function of different requirements. The cup A has to be in a soft plastic material which is resiliently deformable, so that during the screwing of the cap onto the neck of a bottle the guarantie ring 3 passes on top of the formation 13 of the neck and restrain itself immediately under this formation. The internal part C may be choosen in a material which does not react with or which is inert with respect to the content of the bottle and the spring piece B may be realized in a material having the necessary mechanical requirements for its spring function.

In the embodiment shown in FIG. 5, the flaps 10 of the internal part C are carried by an outside skirt 16 of the spring piece B. The internal part C comprises at its upper end notches 17 cooperating with catches 18 of the spring piece in order to avoid any angular displacement between this two parts A and B.

FIG. 5*a* shows a variant of the spring piece B.

In these two last embodiments, all the members (10, 15) having spring functions are grouped on the same part B, the material of which may be choosen in function of the mechanical requirements desired.

What I claim is:

1. A safety closure cap characterised by the fact that it comprises a cup and an internal part, which is retained within said cup but submitted to a resilient action tending to displace it toward the outside of said cup; corresponding ratching formations on the internal wall of the cup and on the outside wall of the internal part, cooperating to drive the internal part in rotation with the cup in only one direction of rotation, whatever the axial position of the internal part is with respect to the cup; and by the fact that corresponding driving formations provided on the internal surface of the cup and on the outside surface of the internal part, cooperate in order to drive the internal part through the cup in the other direction of rotation only when the internal part is axially displaced with respect to the cup against the resilient action.

2. Cap according to claim 1, characterised by the fact that the internal part comprises a spring piece, this spring piece carrying resiliently deformable lugs, fast with a ring, and extending out of the plan of said ring.

3. Cap according to claim 2, characterised by the fact that the resilient lugs of the internal part abutts against the bottom of the cup.

4. Cap according to claim 1, characterised by the fact that the upper face of the internal part carries resilient lugs extending toward the center and toward the bottom of the cup.

5. Cap according to claim 3, characterised by the fact that the spring piece is located between the cup and the internal part.

6. Cap according to claim 5, characterised by the fact that the spring piece carries, spaced around an outside skirt, the ratching formations cooperating with the ratching formations of the cup.

7. Cap according to claim 1, characterised by the fact that the cup comprises a guarantie ring.

* * * * *